US007193603B2

(12) United States Patent
Miyazawa et al.

(10) Patent No.: US 7,193,603 B2
(45) Date of Patent: Mar. 20, 2007

(54) DISPLAY DEVICE HAVING AN IMPROVED VIDEO SIGNAL DRIVE CIRCUIT

(75) Inventors: Toshio Miyazawa, Chiba (JP); Norio Mamba, Kawasaki (JP)

(73) Assignee: Hitachi, Ltd., Tokyo (JP)

( * ) Notice: Subject to any disclaimer, the term of this patent is extended or adjusted under 35 U.S.C. 154(b) by 309 days.

(21) Appl. No.: 10/979,153

(22) Filed: Nov. 3, 2004

(65) Prior Publication Data

US 2005/0088432 A1 Apr. 28, 2005

Related U.S. Application Data

(63) Continuation of application No. 10/119,016, filed on Apr. 10, 2002, now Pat. No. 6,839,047.

(30) Foreign Application Priority Data

Apr. 16, 2001 (JP) ..... 2001-116862

(51) Int. Cl.
*G09G 3/36* (2006.01)

(52) U.S. Cl. ..... 345/100; 345/89; 345/98; 345/206

(58) Field of Classification Search ..... 345/87–89, 345/98–100, 205, 206
See application file for complete search history.

(56) References Cited

U.S. PATENT DOCUMENTS 5,017,919 A * 5/1991 Hull et al. ..... 341/136
5,051,739 A 9/1991 Hayashida et al.
5,196,738 A * 3/1993 Takahara et al. ..... 327/530
5,243,333 A 9/1993 Shiba et al.
5,335,023 A 8/1994 Edwards
5,414,443 A * 5/1995 Kanatani et al. ..... 345/95
5,754,155 A 5/1998 Kubota et al.
6,600,470 B1 * 7/2003 Tsuda ..... 345/89
6,738,055 B1 * 5/2004 Abe et al. ..... 345/211
6,750,835 B2 * 6/2004 Azami ..... 345/89
6,806,859 B1 * 10/2004 Kanoh et al. ..... 345/98
6,947,060 B2 * 9/2005 Abe ..... 345/691
2001/0010512 A1 * 8/2001 Azami ..... 345/100
2001/0011983 A1 * 8/2001 Shiraki et al. ..... 345/92
2002/0008684 A1 * 1/2002 Udo et al. ..... 345/89
2002/0145602 A1 10/2002 Matsueda

FOREIGN PATENT DOCUMENTS

EP 996108 A1 4/2000

* cited by examiner

*Primary Examiner*—Richard Hjerpe
*Assistant Examiner*—Kimnhung Nguyen
(74) *Attorney, Agent, or Firm*—Antonelli, Terry, Stout and Kraus, LLP.

(57) ABSTRACT

A display device includes a plurality of pixels, a plurality of signal lines connected to the plurality of pixels and a drive circuit connected to the plurality of signal lines. The drive circuit includes a distribution port and a decoder, wherein the distribution port distributes supplied data to corresponding circuit portions in the decoder, and the decoder selects gray scale voltages based upon the data from the distribution port. The distribution port includes a first switching stage having two switching elements and a second switching stage having four switching elements and which is electrically connected to the first switching stage. The decoder is disposed between the second switching stage and the plurality of signal lines.

20 Claims, 7 Drawing Sheets

φi (i=A, 1, 2, 3, 4, 5) : CLOCK PULSES,

φ̄i : CLOCK PULSES HAVING OPPOSITE PHASE FROM CLOCK PULSES φi

φi (i=A-F, 1-5) : CLOCK PULSES,

φ̄i : CLOCK PULSES HAVING OPPOSITE PHASE FROM CLOCK PULSES φi

DISPLAY DEVICE HAVING AN IMPROVED VIDEO SIGNAL DRIVE CIRCUIT

CROSS REFERENCE TO RELATED APPLICATION

This is a continuation of U.S. application Ser. No. 10/119,016, filed Apr. 10, 2002 now U.S. Pat. No. 6,839,047, the subject matter of which is incorporated by reference herein.

BACKGROUND OF THE INVENTION

The present invention relates to a display device, and in particular, to a display device having an improved video signal drive circuit.

For example, in an active matrix type liquid crystal display device, a liquid crystal layer is sandwiched between a pair of opposing substrates, formed on a liquid-crystal layer-side surface of one of the pair of substrates are a plurality of gate signal lines extending in an x direction and arranged in a y direction, and a plurality of drain signal lines extending in the y direction and arranged in the x direction, and each of a plurality of pixel areas is surrounded by two adjacent ones of the gate signal lines and two adjacent ones of the drain signal lines.

Each pixel area is provided with a switching element driven by a scanning signal via a gate signal line, and is provided with a pixel electrode supplied with a video signal via the switching element from a drain signal line. The pixel electrode generates an electric field between the pixel electrode and a counter electrode formed on one of the two substrates and thereby controls light transmission through the liquid crystal layer.

One end of each of the gate signal lines is connected to a vertical scanning circuit which sequentially selects one of the gate signal lines based upon the scanning signal. One end of each of the drain signal lines is connected to a video signal drive circuit which supplies a video signal to each of the drain signal lines in synchronism with selection of a corresponding one of the gate signal lines.

Data from an external system such as a microcomputer, for example, are transferred to the video signal drive circuit serially, and then they are supplied to respective ones of the drain signal lines in parallel by a shift register provided within the video signal drive circuit.

SUMMARY OF THE INVENTION

In the liquid crystal display device having the above-described configuration, these day it is pointed out that the speed of transmission of data within the video signal drive circuit has become insufficient as the degree of high definition and the size of the viewing screen are increased.

As the liquid crystal display device is made large-sized and thereby the length of wiring within the display device is increased, parasitic capacitances are increased which are formed by wiring and pixels into which signals are not written, that is, which are not selected, and consequently, time constant is increased. Therefore, time available for writing data into one pixel is decreased as the number of pixels is increased, since rise times of clock and drain signal pulses are approximately represented by $\tau=CR$ in the shift register incorporated within the video signal drive circuit.

Such problems have been pronounced especially in the liquid crystal display devices of the type in which the video signal drive circuit (also the vertical scanning drive circuit) is fabricated directly on one of the two substrates, and transistors constituting the shift register within the drive circuits are fabricated by using polysilicon (p-Si) semiconductor layers simultaneously with switching element (a thin film transistor) disposed within the pixel area, because ON-resistance of those transistors is high. Consequently, in a case where the high-speed transmission of data is required, the shift register itself becomes inoperative, and there has been a demand for elimination of the problem.

The present invention has been made in view of the above-explained situation, and it is one of the present invention to provide a display device capable of high-speed transmission of data.

The following explains the representative ones of the present inventions disclosed in this specification briefly.

In accordance with an embodiment of the present invention, there is provided a display device comprising: a plurality of pixels; a plurality of signal lines for supplying signals to the plurality of pixels; and a video signal drive circuit for receiving data transferred serially from an external system and supplying the signals based upon the data to the plurality of signal lines in parallel, wherein the video signal drive circuit includes a plurality of stages each comprising a column of switching elements, the switching elements constituting the column of each of the plurality of stages double successively in number as a final one of the plurality of stages is approached, each of the switching elements of each of the plurality of stages excluding the final one is connected to a pair of switching elements in a next succeeding one of the plurality stages, each of the pair of switching elements is repeatedly and alternately switched ON with the other of the pair of switching elements being switched OFF, and a frequency of the ON-OFF switching of the pair of switching elements of each of the plurality of stages is successively halved as the final one of the plurality of stages is approached.

In accordance with another embodiment of the present invention, there is provided a display device comprising: a plurality of pixels; a plurality of signal lines for supplying signals to the plurality of pixels; a data conversion circuit for converting an arrangement of data transferred serially from an external system; and a video signal drive circuit for receiving the data transferred serially from the data conversion circuit and supplying the signals based upon the data to the plurality of signal lines in parallel, wherein the video signal drive circuit includes a plurality of stages each comprising a column of switching elements, the switching elements constituting the column of each of the plurality of stages double successively in number as a final one of the plurality of stages is approached, each of the switching elements of each of the plurality of stages excluding the final one is connected to a pair of switching elements in a next succeeding one of the plurality stages, each of the pair of switching elements is repeatedly and alternately switched ON with the other of the pair of switching elements being switched OFF, a frequency of the ON-OFF switching of the pair of switching elements of each of the plurality of stages is successively halved as the final one of the plurality of stages is approached, and the data conversion circuit has a configuration that is a mirror image of the video signal drive circuit.

In accordance with another embodiment of the present invention, there is provided a display device comprising: a plurality of pixels; a plurality of signal lines for supplying signals to the plurality of pixels; and a video signal drive circuit for receiving data transferred serially from an external system and supplying the signals based upon the data to the plurality of signal lines in parallel, wherein the video signal drive circuit includes a plurality of stages each comprising a column of switching elements, the switching elements constituting the column of each of the plurality of stages double successively in number as a final one of the plurality of stages is approached, each of the switching elements of each of the plurality of stages excluding the final one is connected to a pair of switching elements in a next succeeding one of the plurality stages, each of the pair of switching elements is repeatedly and alternately switched ON with the other of the pair of switching elements being switched OFF, a frequency of the ON-OFF switching of the pair of switching elements of each of the plurality of stages is successively halved as the final one of the plurality of stages is approached, and the video signal drive circuit further includes a store memory section for grouping and storing therein the data transferred from the final one of the plurality of stages.

The display devices having the above configurations are capable of reducing substantial input load-capacitances and thereby time constant $\tau=CR$ greatly in their video signal drive circuit, and thereby are capable of increasing the speed of transmission of data (digital data) and also reducing their power consumption even when the size of their viewing screen and the degree of high definition are increased. Although a clock having the highest speed is required for a column of switching elements in the first stage, the present invention makes it possible to provide the highest speed clock to the column of switching elements externally, and thereby is capable of relaxing restrictions imposed on high-speed read-in operation by insufficient driving capability of the switching elements provided in the pixel areas. These advantages become more pronounced when the switching elements are thin film transistors fabricated by using polysilicon semiconductor layers.

BRIEF DESCRIPTION OF THE DRAWINGS

In the accompanying drawings, in which like reference numerals designate similar components throughout the figures, and in which.

DETAILED DESCRIPTION OF THE PREFERRED EMBODIMENTS

Embodiments of the liquid crystal display device in accordance with the present invention will be explained by reference to the drawings.

Embodiment 1

Overall Configuration

Figure 2:
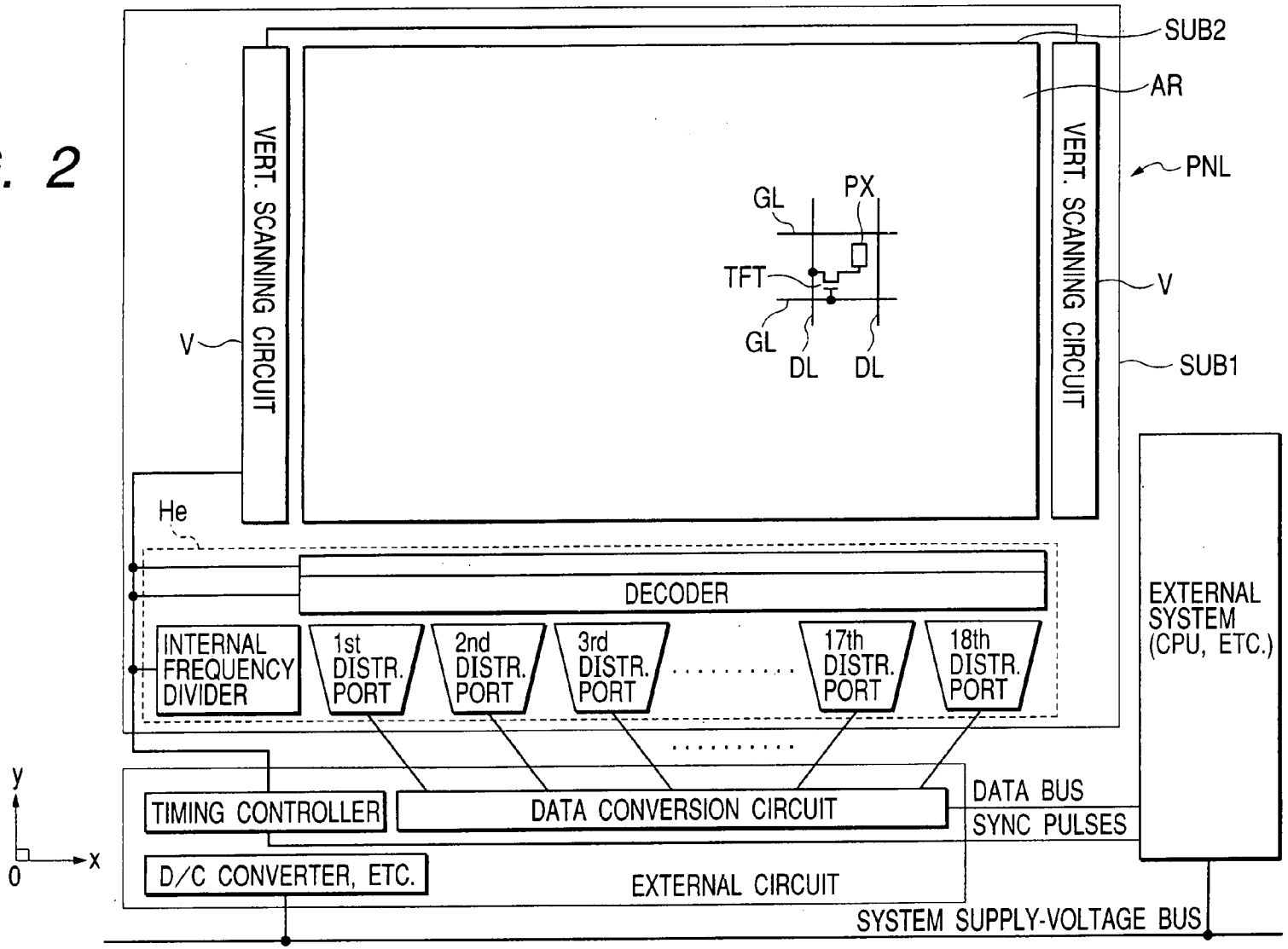
FIG. 2 illustrates a liquid crystal display as an embodiment of a display device in accordance with the present invention, showing its liquid crystal display panel and its peripheral circuits.

FIG. 2 illustrates a liquid crystal display panel PNL and its peripheral circuits as an embodiment of a display device in accordance with the present invention.

The liquid crystal display panel PNL shown in FIG. 2 comprises a pair of opposing substrates SUB1 and SUB2, a liquid crystal layer sandwiched between the substrates SUB1 and SUB2. Formed on a liquid-crystal-layer side surface of the substrate SUB1 are a plurality of gate signal lines GL extending in an x direction and arranged in a y direction and a plurality of drain signal lines DL extending in the y direction and arranged in the x direction.

Each of rectangular areas surrounded by two adjacent ones of the gate signal lines GL and two adjacent ones of the drain signal lines DL forms one pixel area, and a matrix array of the pixel areas form a liquid crystal display section AR.

Each of the pixel areas is provided with a thin film transistor TFT driven by a scanning signal from a corresponding one of the gate signal lines GL, and a pixel electrode PX supplied with a video signal via the thin film transistor TFT from a corresponding one of the drain signal lines DL. The pixel electrode PX generates an electric field between the pixel electrode PX and a counter electrode (not shown) formed on a liquid-crystal-layer side surface of one of the two substrates SUB1, SUB2 and thereby controls light transmission through the liquid crystal layer.

The substrate SUB1 fabricated as explained above is superposed on the other substrate SUB2 with the liquid crystal layer interposed therebetween in the liquid crystal display section AR, and the two substrates SUB1 and SUB2 are fixed together by a sealing member which also serves to seal up the liquid crystal layer therebetween. Each of the gate signal lines GL disposed in the liquid crystal display section AR extends beyond the sealing member such that both its ends are connected to two vertical scanning circuits V fabricated on the substrate SUB1, respectively. Each of the drain signal lines DL disposed in the liquid crystal display section AR extends beyond the sealing member such that one of its two ends is connected to a video signal drive circuit He fabricated on the substrate SUB1.

Each of the gate signal lines GL is selected by a scanning signal from the vertical scanning circuit V, turns ON all the thin film transistors TFT of a group of the pixels coupled to the selected one of the gate signal lines GL, and in synchronism with this, video signals are output to respective ones of the drain signal lines DL from the video signal drive circuit He. The video signals are supplied to respective ones of the pixel electrodes PX of the pixels of the group via the turned-ON thin film transistors TFT. The video signal drive circuit He will be explained in further detail subsequently.

On the other hand, there is provided an external system such as a microcomputer system or the like, and this external system supplies data, sync pulses and supply voltages to external circuits disposed around the liquid crystal display panel PNL. The external circuit includes data conversion circuits and a timing controller for taking in the data and sync pulses from the external system, respectively. The data conversion circuit is configured so as to change the arrangement of the data supplied from the external system such that the converted data from the conversion circuit suit with the configuration of distribution ports (a first distribution port, a second distribution port, a third distribution port, . . . , and an eighteenth distribution port) serving as the first-stage circuit of the video signal drive circuit He for the liquid crystal display panel PNL, and further details of the data conversion circuit will be explained subsequently.

Each of the distribution ports is configured such that the arrangement of data supplied from the data conversion circuit are changed, and therefore the data conversion circuit changes the arrangement of the data in advance, taking into account the subsequent conversion of the arrangement of the data by the distribution ports. In other words, initially the data conversion circuit changes data supplied in the regular arrangement from the external system, and thereafter the distribution ports convert the data from the data conversion circuit into the data in the regular arrangement.

Voltages corresponding to gray scale levels are selected by a decoder included in the video signal drive circuit in accordance with the data from the distribution ports, and they are supplied to the respective drain signal lines DL.

Configuration of the Distribution Ports

Figure 1:
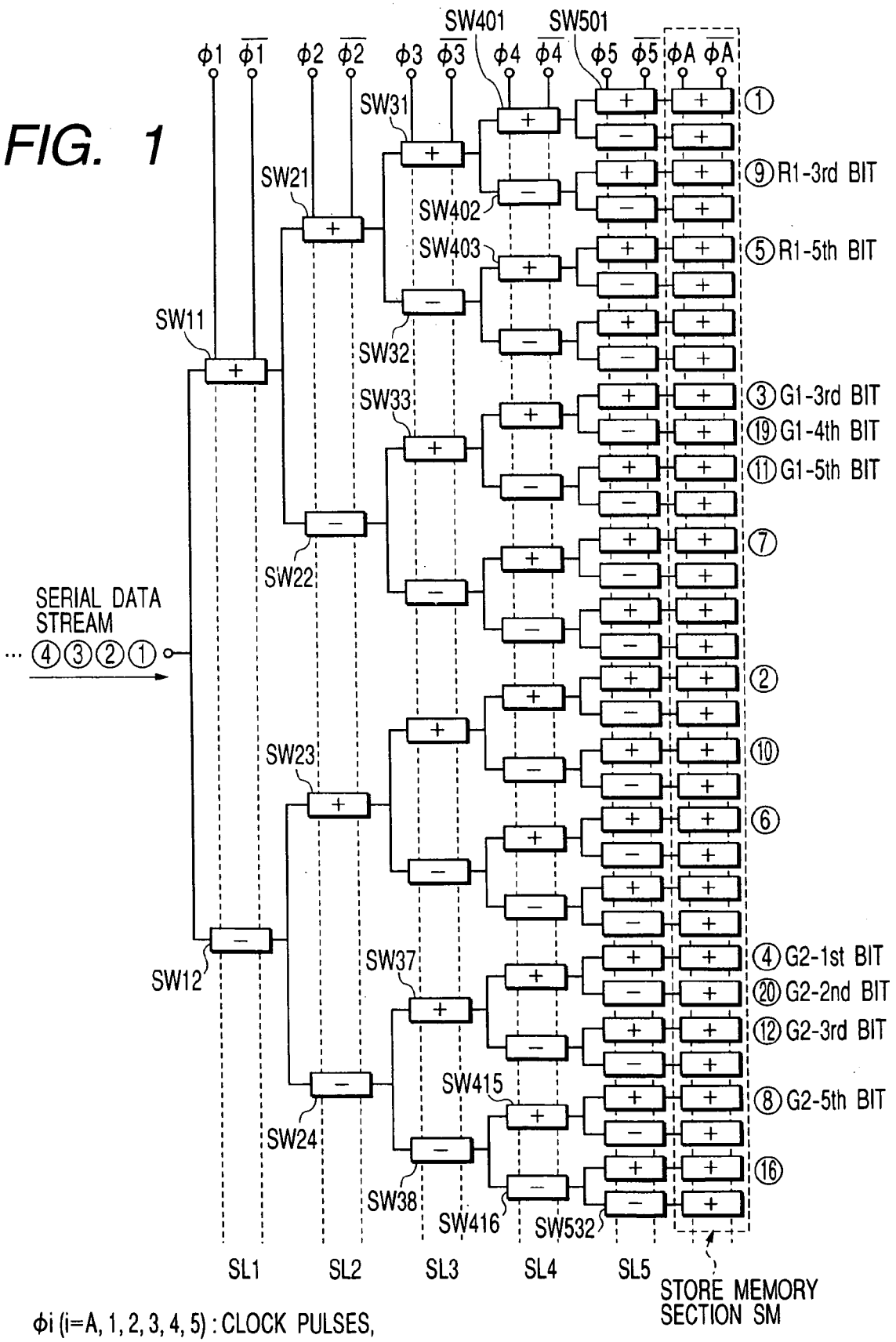
FIG. 1 is a circuit diagram illustrating an embodiment of a display device in accordance with the present invention, showing a major circuit portion of a video signal drive circuit employed in the display device.

FIG. 1 is a circuit diagram of an example of the distribution port used as the above-mentioned first, second, . . . , and eighteenth distribution ports.

As is apparent from FIG. 1, one distribution port comprises a column SL1 of switching elements constituting the first stage serving as an input stage, a column SL2 of switching elements constituting the second stage, a column SL3 of switching elements constituting the third stage, a column SL4 of switching elements constituting the fourth stage, a column SL5 of switching elements constituting the fifth stage, and a store memory section SM. The column SL1 of switching elements of the first stage is composed of two ($2^1$) switching elements, the column SL2 of switching elements of the second stage is composed of four ($2^2$) switching elements, the column SL3 of switching elements of the third stage is composed of eight ($2^3$) switching elements, the column SL4 of switching elements of the fourth stage is composed of sixteen ($2^4$) switching elements, and the column SL5 of switching elements of the fifth stage is composed of thirty-two ($2^5$) switching elements.

Figure 3A:
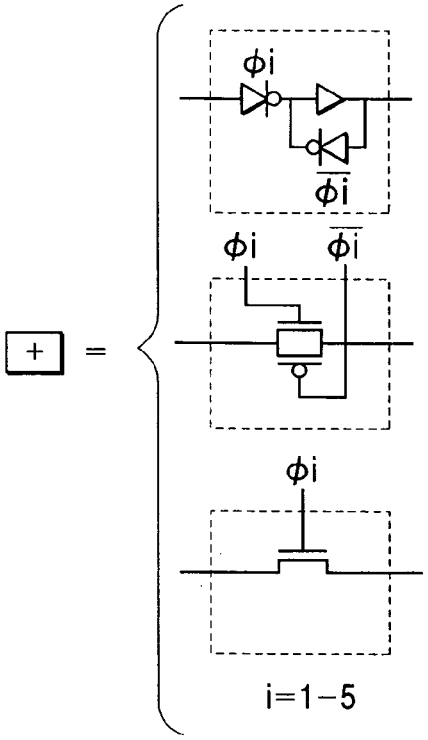
FIGS. 3A and 3B are circuit diagrams of examples of two types of switching elements used in the video signal drive circuit of FIG. 1, respectively.
Figure 3B:
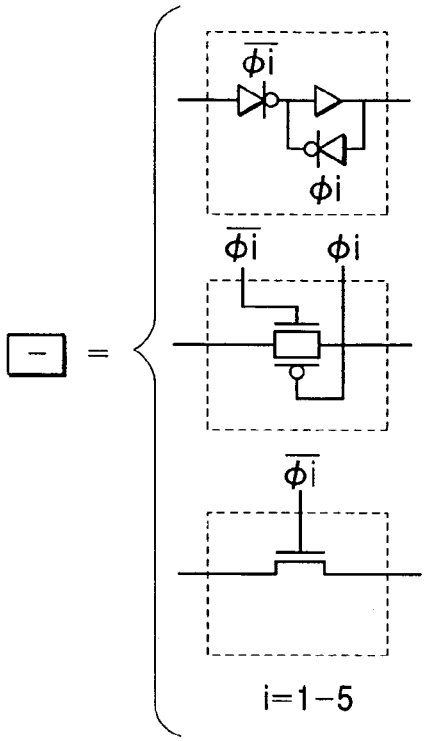

Each of the switching elements SW constituting the columns of the switching elements of the respective stages has one of configurations enclosed by broken lines in FIGS. 3A and 3B. When switching elements SW of one type (for example, switching elements denoted by "+" in FIG. 1) is turned ON, depending upon a clock signal supplied thereto, switching elements SW of the other type (for example, switching elements denoted by "–" in FIG. 1) is turned OFF, and vice versa. The clock signal alternately turns ON each type of the two types of the switching elements with turning OFF the other type of the two types of the switching elements. This cycle of the ON and OFF operation is repeated.

In each of the columns SL of the switching elements SW of the respective stages, the switching elements SW of two different types are arranged alternately. Each of the switching elements SW arranged in a switching-element column SL in one stage is connected to a pair of adjacent ones of the switching elements SL arranged in a switching-element column SL in the next succeeding stage.

For example, in FIG. 1, a switching element SW 11 disposed in an upper half of the column SL1 of the first stage is connected to a pair of switching elements SW21 and SW22 disposed in an upper half of the column SL2 of the second stage, a switching element SW 12 disposed in a lower half of the column SL1 of the first stage is connected to a pair of switching elements SW23 and SW24 disposed in a lower half of the column SL2 of the second stage.

Figure 4:
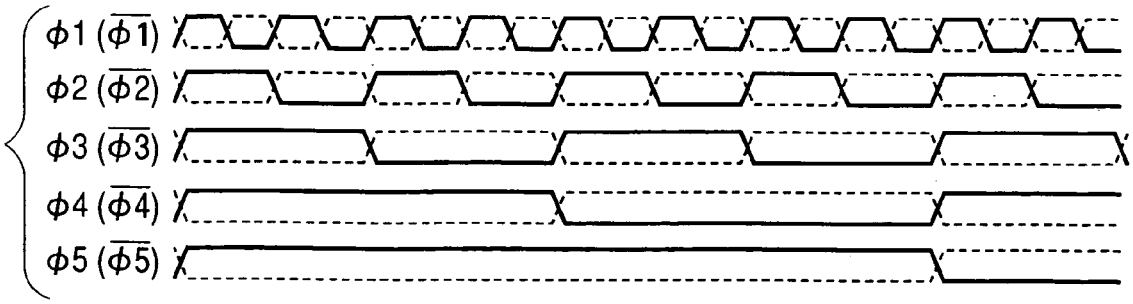
FIG. 4 is a timing chart of clock signals supplied to the switching elements shown in FIG. 1.

The switching elements SW in the columns SL of the respective stages are supplied with clock pulses $\phi i$(i=1, 2, 3, 4, 5) or clock pulses $/\phi i$(i=1, 2, 3, 4, 5) having opposite phase from the clock pulses $\phi i$ as illustrated in FIG. 4 (in this specification, a slant "/" is used to indicate that a clock pulse $/\phi i$ has opposite phase from a clock pulse $\phi i$, but the bar "¯" is used instead of the slant "/" in the drawings).

Figure 5A:
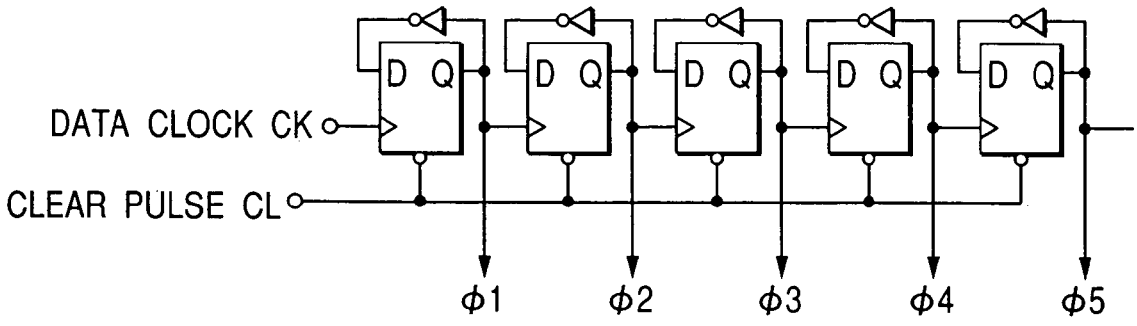
FIG. 5A is a circuit diagram of an example of a frequency divider for generating clock signals supplied to the video signal drive circuit of FIG. 1.
Figure 5B:
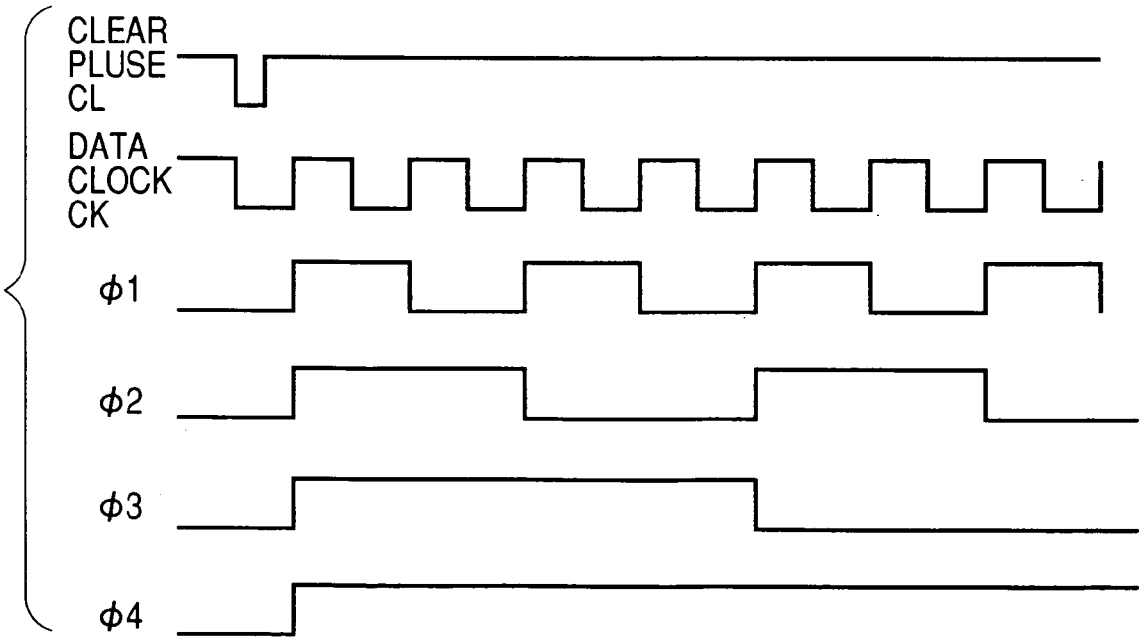
FIG. 5B is a timing chart of the generated clock signals.

A frequency of a clock pulse $\phi 2$ supplied to the switching elements in the column SL2 of the second stage is half that of a clock pulse $\phi 1$ supplied to the switching elements in the column SL1 of the first stage, a frequency of a clock pulse $\phi 3$ supplied to the switching elements in the column SL3 of the third stage is one fourth of that of the clock pulse $\phi 1$, a frequency of a clock pulse $\phi 4$ supplied to the switching elements in the column SL4 of the fourth stage is one eighth of that of the clock pulse $\phi 1$, and a frequency of a clock pulse $\phi 5$ supplied to the switching elements in the column SL5 of the fifth stage is one sixteenth of that of the clock pulse $\phi 1$. These clock pulses $\phi i$(i=1–5) are supplied from an internal frequency divider shown in FIG. 2, and an example of the internal frequency divider is illustrated in detail in FIG. 5A. In FIG. 5A, the frequency divider is composed of five flip-flops connected in series, and in response to inputs of data clock pulses CK and a clear pulse CL shown in FIG. 5B, the clock pulses $\phi 1$, $\phi 2$, $\phi 3$, $\phi 4$ and $\phi 5$ are output from the first, second, third, fourth and fifth flip-flops, respectively.

In the distribution port of this configuration, first the data from the above-explained data conversion circuit is input to the switching elements SW11 and SW12 in the column SL1 of the first stage, and the switching elements SW11 and SW12 are supplied with the clock pulses $\phi 1$ and $/\phi 1$. The relationship between the clock pulses $\phi 1$ and $/\phi 1$ is illustrated in FIG. 4, where the clock pulses $\phi 1$ and $/\phi 1$ are represented by solid lines and broken lines, respectively.

With this configuration, when one of the switching elements SW11 and SW12 is turned ON, and the other one of the switching elements SW11 and SW12 is turned OFF, and vice versa. The clock signals alternately turn ON each of the switching elements SW11 and SW 12 with turning OFF the other of the switching elements SW11 and SW 12. This operation is repeated. Consequently, among data ①, ②, ③, ④, ⑤, ⑥, ⑦, ⑧, ⑨ . . . supplied serially from the data conversion circuit, data ① and data ② are transferred to the switching element column SL2 of the second stage via the switching element SW11 and the switching element SW12, respectively, and data ③ and data ④ are transferred to the switching element column SL2 of the second stage via the switching element SW11 and the switching element SW12, respectively.

The switching element column SL2 of the second stage is composed of four switching elements SW21, SW22, SW23 and SW24, which are supplied with the clock pulses $\phi 2$ and $/\phi 2$. The relationship between the clock pulses $\phi 2$ and $/\phi 2$ is illustrated in FIG. 4, where the clock pulses $\phi 2$ and $/\phi 2$ are represented by solid lines and broken lines, respectively. The frequency of the clock pulses $\phi 2$ and $/\phi 2$ is half that of the clock pulses $\phi 1$ and $/\phi 1$.

With this configuration, when the switching elements SW21 and SW23 among the switching elements SW21, SW22, SW23 and SW24 are turned ON, and the switching elements SW22 and SW24 are turned OFF, and vice versa. The clock signals alternately turns ON each of one pair of the switching elements SW21 and SW 23 and another pair of the switching elements SW22 and SW 24 with turning OFF the other of the two pairs. This operation is repeated. As a result, the data ① transferred via the switching element SW11 is transferred to the switching element column SL3 of the third stage via the switching element SW21, the data ② transferred via the switching element SW12 is transferred to the switching element column SL3 of the third stage via the switching element SW23, data ③ transferred via the switching element SW11 is transferred to the switching element column SL3 of the third stage via the switching element SW22.

Such operations are successively repeated, and finally the data transferred via respective ones of the elements SW501–SW532 in the column SL5 of the fifth stage are stored in the store memory section SM for subsequent processing.

Data Conversion Circuit

Apparent from operation of the circuit of the distribution port, the arrangement of the data stored in the store memory section SM is different from the arrangement of the data input into the distribution port as indicated in FIG. 1 at the extreme right of which the arrangement of some of the data stored in the store section SM is indicated.

In view of the above, in this embodiment, the data conversion circuit is configured so as to change the arrangement of the data transferred from the external system in advance before inputting the data into the distribution ports, taking into account the subsequent conversion of the arrangement of the data by the distribution ports. In other words, a so-called inverse conversion is performed by the data conversion circuit.

Figure 6:
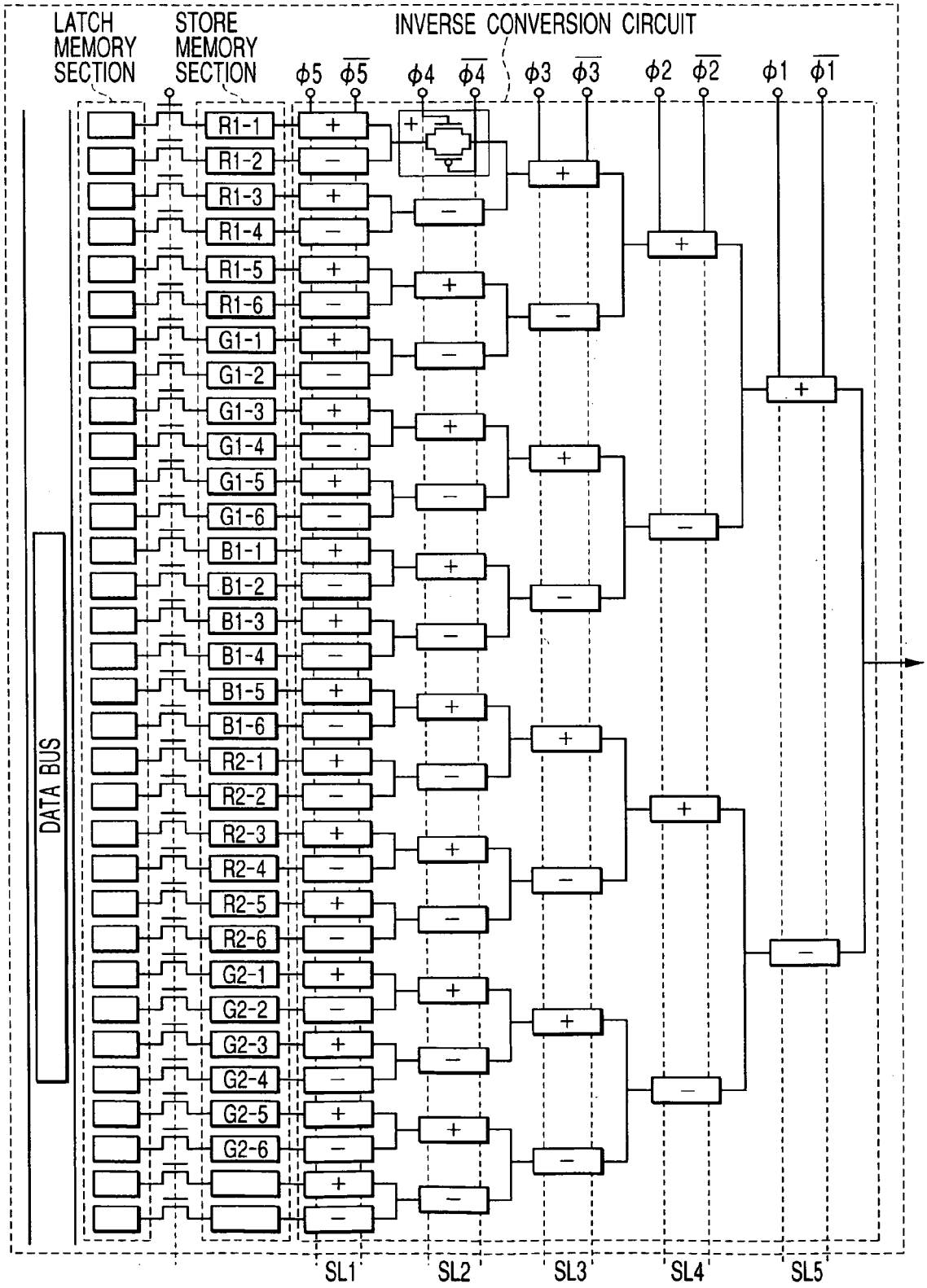
FIG. 6 is a circuit diagram of an example of an inverse conversion circuit employed in the display device in accordance with the present invention.

As shown in FIG. 6, data supplied via a data bus from the external system are input into a latch memory section, and then are input into the store memory section SM. The data from respective memory elements of the store memory section SM are input into the data conversion circuit, which has the same configuration as a configuration obtained by reversing the arrangement of the input and output sides of the distribution port shown in FIG. 1. That is to say, the data conversion circuit is comprised of the switching element column SL1 of the first stage, the switching element column SL2 of the second stage, the switching element column SL3 of the third stage, the switching element column SL4 of the fourth stage, and the switching element column SL5 of the fifth stage.

The switching element column SL1 of the first stage is composed of thirty-two ($2^5$) switching elements, and corresponds to the switching element column SL5 of the fifth stage of the distribution port. The switching element column SL2 of the second stage is composed of sixteen ($2^4$) switching elements, and corresponds to the switching element column SL4 of the fourth stage of the distribution port. The switching element column SL3 of the third stage is composed of eight ($2^3$) switching elements, and corresponds to the switching element column SL3 of the third stage of the distribution port. The switching element column SL4 of the fourth stage is composed of four ($2^2$) switching elements, and corresponds to the switching element column SL2 of the second stage of the distribution port. The switching element column SL5 of the fifth stage is composed of two ($2^1$) switching elements, and corresponds to the switching element column SL1 of the first stage of the distribution port. A pair of switching elements SW in each of the switching element columns SLi (i=1–5) are connected to one of switching elements of the switching element column of the next succeeding stage.

Since the above-explained data conversion circuit has a configuration that is the mirror image of the distribution port, irrespective of how data are converted in the distribution port, the data supplied serially from the external system can be arranged in parallel with retaining the original arrangement of the data. Further, such a data conversion circuit has the same configuration as that of the distribution port, and is supplied with the same clock signals as those supplied to the distribution port, and consequently, problems such as increasing of time constants are not caused.

Embodiment 2

Figure 7:
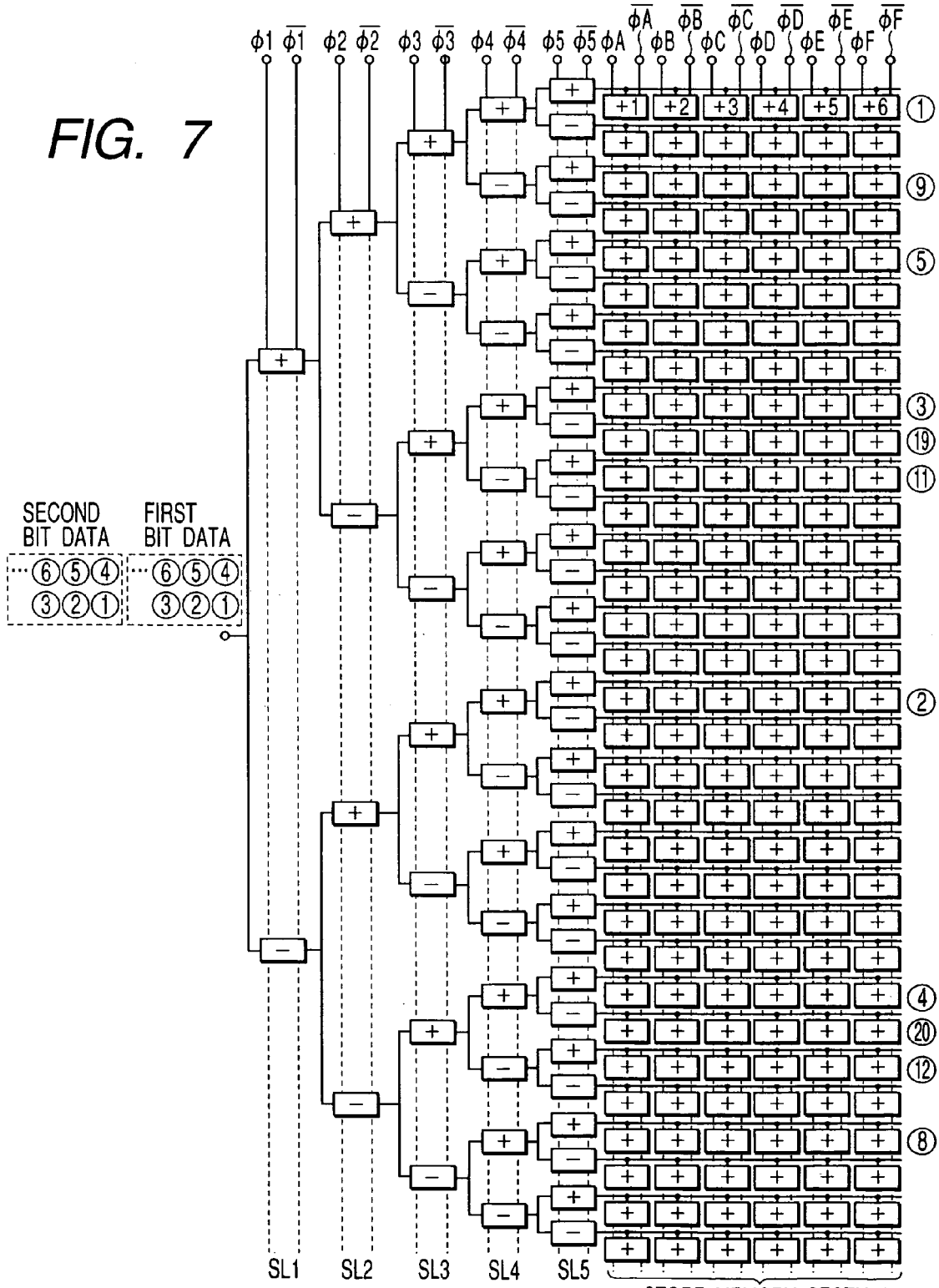
FIG. 7 is a major circuit portion of another embodiment of a video signal drive circuit employed in a display device in accordance with the present invention.
Figure 8:
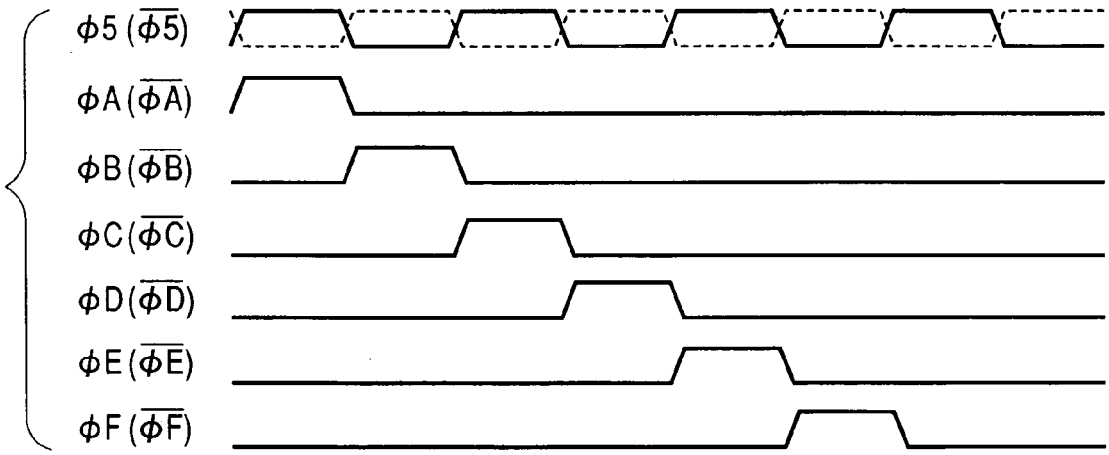
FIG. 8 is a timing chart of clock signals supplied to a store memory section employed in the video signal drive circuit shown in FIG. 7.

FIG. 7 illustrates another embodiment of a distribution port employed in the liquid crystal display device in accordance with the present invention, and is a circuit diagram similar to that of FIG. 1. The configuration of FIG. 7 differs from that of FIG. 1 in that data each comprising six bits representing color information for one pixel are input to the distribution port, and the data are grouped and stored in the store memory section. The store memory section is formed by memory blocks into which six-bit data supplied via the respective switching elements of the switching element column of the fifth stage are successively stored. Pulses ϕ–A–ϕF and /ϕA–ϕF driving the store memory section are illustrated in FIG. 8, and they are synchronized with ON-Off operation of the switching element column SL5 of the fifth stage.

Initially, first-bit data are input successively into the input stage of the distribution port, are transferred to the switching element column SL5 of the fifth stage as explained in connection with Embodiment 1, and then are stored in the store memory section. Then second-bit data are input successively into the input stage of the distribution port, are transferred to the switching element column SL5 of the fifth stage, and then are stored in the store memory section as in the case of the first-bit data.

In this case, all the bit data for representing color information of one pixel take the same route to the switching element column SL5 in FIG. 7, and therefore they are transferred to the corresponding memory positions of the store memory section via the corresponding switching elements SW. Consequently, six bits representing color information for each pixel are grouped together and then are stored in the store memory section, and this provides an advantage of facilitating subsequent processing of the data.

Further, even in a case where the store memory section is formed of shift registers, for example, since the frequency of pulses for driving the shift registers is relatively lower, no problems associated with employment of the shift registers occur, such as a problem caused by high-speed operation of the shift registers.

As explained above, the display device in accordance with the present invention makes possible high-speed data transmission within the video signal drive circuit.

While the above-explained embodiments are applicable to all types of liquid crystal display devices, it is very effective for the present invention to be applied to a liquid crystal display device of the type in which the video signal drive circuit He is fabricated directly on the transparent substrate SUB1, for example, (in this case, usually the vertical scanning drive circuit V is also fabricated), and transistors constituting the shift register within the drive circuits are fabricated by using polysilicon (p-Si) semiconductor layers simultaneously with thin film transistors TFT disposed within the pixel areas. Although driving capability of those transistors are not very great at the present time, the present invention is capable of a large-sized and high-definition display device.

The above embodiments have been explained in connection with the liquid crystal display devices, but the present invention is not limited to those, and it is needless to say that the present invention is applicable to other display devices such as an electroluminescent display device, because the basic configuration of the video signal drive circuit for such display devices is the same as that for the liquid crystal display devices.

As is apparent from the above explanation, the display device in accordance with the present invention makes possible the high-speed data transmission within its video signal drive circuit.

What is claimed is:

1. A display device comprising:

a plurality of pixels;

a plurality of signal lines connected to the plurality of pixels; and a drive circuit connected to the plurality of signal lines, the drive circuit comprising a distribution port and a decoder;

wherein the distribution port distributes supplied data to corresponding circuit portions in the decoder, and the decoder selects gray scale voltages based upon the data from the distribution port, the distribution port including a first switching stage having two switching elements and a second switching stage having four switching elements and which is electrically connected to the first switching stage; and wherein the decoder is disposed between the second switching stage and the plurality of signal lines.

2. A display device according to claim 1, wherein the first switching stage is supplied with a first clock signal, and the second switching stage is supplied with a second clock signal having a frequency which is one half of a frequency of the first clock signal.

3. A display device according to claim 2, wherein the first clock signal includes a first clock pulse and a second clock pulse which has an opposite phase from a phase of the first clock pulse, and the second clock signal includes a third clock pulse and a fourth clock pulse which has an opposite phase from a phase of the third clock pulse.

4. A display device according to claim 3, wherein the two switching elements of the first switching stage receive serial data, and the four switching elements of the second stage receive output data from the first switching stage.

5. A display device according to claim 3, wherein the distribution port further includes a third switching stage having eight switching elements and which is electrically connected to the second switching stage, a fourth switching stage having sixteen switching elements and which is electrically connected to the third switching stage, and a fifth switching stage having thirty-two switching elements and which is electrically connected to the fourth switching stage.

6. A display device according to claim 5, wherein the decoder is electrically connected to the fifth switching stage.

7. A display device according to claim 5, wherein the third switching stage is supplied with a fifth clock pulse and a sixth clock pulse which has an opposite phase from a phase of the fifth clock pulse, the fourth switching stage is supplied with a seventh clock pulse and an eighth clock pulse which has an opposite phase from a phase of the seventh clock pulse, and the fifth switching stage is supplied with a ninth clock pulse and a tenth clock pulse which has an opposite phase from a phase of the ninth clock pulse.

8. A display device according to claim 6, wherein the ninth clock pulse has a frequency which is one half of a frequency of the seventh clock pulse, the seventh clock pulse has a frequency which is one half of a frequency of the fifth clock pulse, and the fifth clock pulse has a frequency which is one half of a frequency of the third clock pulse.

9. A display device according to claim 8, wherein the tenth clock pulse has a frequency which is one half of a frequency of the eighth clock pulse, the eighth clock pulse has a frequency which is one half of a frequency of the sixth clock pulse, and the sixth clock pulse has a frequency which is one half of a frequency of the fourth clock pulse.

10. A display device according to claim 4, further comprising a data conversion circuit electrically connected to the drive circuit, wherein the data conversion circuit changes an arrangement of externally supplied data, and outputs the rearranged data as the serial data to the distribution port.

11. A display device according to claim 10, wherein the data conversion circuit includes a first conversion switching stage having two switching elements and which outputs the serial data, and a second conversion switching stage having four switching elements and which is electrically connected to the first switching stage.

12. A display device according to claim 11, wherein the first conversion switching stage is supplied with an eleventh clock pulse and a twelfth clock pulse which has an opposite phase from a phase of the eleventh clock pulse, and the second conversion switching stage is supplied with a thirteenth clock pulse and a fourteenth clock pulse which has an opposite phase from a phase of the thirteenth clock pulse.

13. A display device according to claim 12, wherein the first clock pulse and the eleventh clock pulse have a same frequency, and the third clock pulse and the thirteenth clock pulse have a same frequency.

14. A display device comprising:

a plurality of pixels;

a plurality of signal lines connected to the plurality of pixels; and a drive circuit connected to the plurality of signal lines, the drive circuit comprising a distribution port and a decoder;

wherein the distribution port distributes supplied data to corresponding circuit portions in the decoder, and the decoder selects gray scale voltages based upon the data from the distribution port, the distribution port including a first switching stage having two switching elements and which receives serial data, and a second switching stage having four switching elements and which is electrically connected to the first switching stage;

wherein the two switching elements of the first switching stage receive a first clock pulse and a second clock pulse which has an opposite phase from a phase of the first clock pulse, and the four switching elements of the second switching stage receive a third clock pulse and a fourth clock pulse which has an opposite phase from a phase of the third clock pulse; and wherein the decoder is disposed between the second switching stage and the plurality of signal lines.

15. A display device according to claim 14, wherein the third clock pulse and the fourth clock pulse have a frequency which is one half of a frequency of the first clock pulse and the second clock pulse.

16. A display device according to claim 14, further comprising:

a data conversion circuit electrically connected to the drive circuit;

wherein the data conversion circuit changes an arrangement of externally supplied data, and outputs the rearranged data to the distribution port;

wherein the data conversion circuit includes a first conversion switching stage having two switching elements and a second conversion switching stage having four switching elements and which is electrically connected to the first switching stage; and wherein the first conversion switching stage outputs the serial data to the drive circuit.

17. A display device according to claim 15, wherein the first conversion switching stage is supplied with a fifth clock pulse and a sixth clock pulse which has an opposite phase from a phase of the fifth clock pulse, and the second conversion switching stage is supplied with a seventh clock pulse and an eighth clock pulse which has an opposite phase from a phase of the seventh clock pulse.

18. A display device according to claim 17, wherein the third clock pulse and the fourth clock pulse have a frequency which is one half of a frequency of the first clock pulse and the second clock pulse.

19. A display device according to claim 17, wherein the seventh clock pulse and the eighth clock pulse have a frequency which is one half of a frequency of the fifth clock pulse and the sixth clock pulse.

20. A display device according to claim 17, wherein the first clock pulse and the fifth clock pulse have a same frequency, and the third clock pulse and the seventh clock pulse have a same frequency.

* * * * *